US007176853B2

(12) United States Patent
Kang

(10) Patent No.: US 7,176,853 B2
(45) Date of Patent: Feb. 13, 2007

(54) PANEL DRIVING METHOD AND APPARATUS FOR REPRESENTING GRADATION BY MIXING ADDRESS PERIOD AND SUSTAIN PERIOD

(75) Inventor: Kyoung-Ho Kang, Suwon (KR)

(73) Assignee: Samsung SDI Co., Ltd., Suwon (KR)

( * ) Notice: Subject to any disclaimer, the term of this patent is extended or adjusted under 35 U.S.C. 154(b) by 598 days.

(21) Appl. No.: 10/725,524

(22) Filed: Dec. 3, 2003

(65) Prior Publication Data

US 2004/0108974 A1 Jun. 10, 2004

(30) Foreign Application Priority Data

Dec. 3, 2002 (KR) ..... 10-2002-0076217

(51) Int. Cl.
*G09G 3/28* (2006.01)

(52) U.S. Cl. ..... 345/60; 345/204

(58) Field of Classification Search ..... 345/60–69, 345/204–215

See application file for complete search history.

(56) References Cited

U.S. PATENT DOCUMENTS 5,541,618 A 7/1996 Shinoda ..... 345/60
5,903,245 A 5/1999 Shimizu et al.
6,271,811 B1 8/2001 Shimizu et al.
6,340,960 B1 1/2002 Song et al. ..... 345/60
6,362,800 B1 3/2002 Moon
2004/0160392 A1* 8/2004 Kim et al. ..... 345/63
2005/0035935 A1* 2/2005 Kang et al. ..... 345/87

FOREIGN PATENT DOCUMENTS

JP 2001-184022 6/2001

* cited by examiner

*Primary Examiner*—Vijay Shankar
(74) *Attorney, Agent, or Firm*—H C Park & Associates, PLC

(57) ABSTRACT

A panel driving method for driving pixels of a panel. The pixels are classified into a plurality of groups and the pixels of one of the plurality of groups are addressed and sustain-discharged before the pixels of another one of the plurality of groups are addressed and sustain discharged. In the panel driving method, a frame period for displaying a single image is divided into a plurality of sub-fields, each of which has a predetermined gradation, and the sub-fields are selectively operated to determine a gradation of visual brightness for each cell. In at least one of the sub-fields, an address period and a sustain period are sequentially performed on the pixels of each of the groups. While an address period is being performed on the pixels of a one of the groups, the pixels of other groups are idle. While a sustain period subsequent to the address period is being performed on the pixels of one of the group, a sustain period is selectively performed on the pixels of each of other groups that have already undergone an address period.

19 Claims, 16 Drawing Sheets

FIG. 10A

| SUB-FIELD NO. | 1 | 2 | 3 | 4 | 5 | 6 | 7 | 8 |
|---|---|---|---|---|---|---|---|---|
| GRADE / ELECTRODE | 1 | 2 | 4 | 8 | 16 | 32 | 64 | 128 |
| G1 | $Y_{11}$ $Y_{12}$ ... | | | | | | | |
| G2 | $Y_{21}$ $Y_{22}$ ... | | | | | | | |
| ... | ... | | | | | | | |
| $G_n$ | $Y_{n1}$ $Y_{n2}$ ... | | | | | | | |

PANEL DRIVING METHOD AND APPARATUS FOR REPRESENTING GRADATION BY MIXING ADDRESS PERIOD AND SUSTAIN PERIOD

BACKGROUND OF THE INVENTION

This application claims priority from Korean Patent Application No. 2002-76217, filed on Dec. 3, 2002, in the Korean Intellectual Property Office, the disclosure of which is incorporated herein in its entirety by reference.

1. Field of the Invention

The present invention relates to a method and apparatus for representing a gradation on a display device which displays a picture by sequentially executing an address period and a sustain period, such as, a plasma display panel (PDP).

2. Description of the Related Art

A known PDP electrode driving method is disclosed in U.S. Pat. No. 5,541,618. A conventional panel driving method has three timing period, including a reset (initialization) period, an address (write) period, and a sustain (display) period. During the reset period, each cell is initialized so that an addressing operation can be properly performed on each cell. During the address period, wall charges are accumulated on the cells which are to be lit in a panel. During the sustain period, a discharge for picture display takes place on the addressed cells.

The above U.S. Patent discloses a method of driving a PDP by separately executing over time an address period and a sustain period in order to represent a gradation in a frame-subfield structure. A sustain operation is executed concurrently on all pixels after all scan electrodes are completely addressed. According to this driving method, a sustain discharge operation of a certain scan line is not performed until the last scan line finishes an addressing operation.

Therefore, in the known method for representing a gradation, a significant time gap exists from an addressing operation to a sustain discharge operation on the addressed cell. This may cause an unstable sustain discharge operation.

SUMMARY OF THE INVENTION

This invention provides a panel driving method for allowing a smooth sustain discharge by minimizing the time interval between an address period and a sustain period to represent a gradation, and a panel driving apparatus therefore.

According to an aspect of the present invention, there is provided a panel driving method for driving pixels of a panel, where the pixels are classified into a plurality of groups and addressed and sustain-discharged before the pixels of another one of the plurality of groups are addressed and sustain-discharged. A frame period for displaying a single image is divided into a plurality sub-fields to each of which a predetermined gradation weight is allocated. The sub-fields are selectively operated to determine a gradation of visual brightness for each cell. At least one of the sub-fields comprises a write/sustain mixed period for sequentially applying address signals, during an address period, and sustain signals, during a sustain period, to the pixels of one of the plurality of groups before applying address signals and sustain signals to the pixels of another of the plurality of groups. The step of applying address signals and sustain signals is repeated for each of the plurality of groups. While a sustain period is being performed on the pixels of one of the plurality of groups, the pixels of the others of the plurality of groups to which address signals and sustain signals have already been applied are selectively subjected to sustain periods. The method further involves during a concurrent sustain period, performing a predetermined length of sustain period concurrently on the pixels of all of the plurality of groups, and during a brightness compensation period, selectively performing an additional sustain period on the pixels of each of the plurality of groups so that the pixels of each of the plurality of groups satisfy a predetermined gradation allocated to the sub-field.

According to an aspect of the present invention, there is provided a panel driving method in which sub-fields are selectively operated to determine a gradation of visual brightness for each cell. At least one of the sub-fields is driven by sequentially performing an address period and a sustain period on the pixels of each of the plurality of groups. The method involves performing a sequence of an address period and a sustain period on the pixels of one of the plurality of groups before performing an address period on the pixels of another one of the plurality of groups, and the step of performing a sequence of an address period and a sustain period on the pixels of one of the plurality of groups is repeated until all of the plurality of groups have undergone the sequence of an address period and a sustain period. Further, while performing the sustain period on the pixels of the group which was most recently addressed, a sustain period is selectively performed on the pixels of at least one other group that has already undergone an address period, and has not yet obtained a predetermined gradation by the already performed sustain periods. While the pixels of all the other groups of the plurality of groups that have already undergone an address period and have already obtained the predetermined gradation by the already performed sustain periods are maintained in an idle state, and after the pixels of all of the plurality of groups have undergone an address period and a sustain period, the method further involves performing an additional sustain period on the pixels of each of the plurality of groups that do not satisfy the predetermined gradation.

According to another aspect of the present invention, there is provided a panel driving apparatus comprising a sub-field processor dividing a frame period during which a picture is displayed into a plurality of sub-fields, a signal synthesis unit which generates an address signal for addressing pixels to be lit and a sustain signal for sustain-discharging the addressed pixels, and a pixel driving unit which selectively operates the sub-fields and driving the pixels of the individual groups in response to the address signals and the sustain signals that are output from the signal synthesis unit, to determine a gradation of visual brightness for each pixel. The signal synthesis unit generates the address signals and the sustain signals so that at least one of the sub-fields is driven by sequentially performing an address period and a sustain period on the pixels of one of the plurality of groups in such a way that while an address period is being performed on the pixels of one of the plurality of groups, the pixels of other groups are idle, and while a sustain period on the pixels of the groups which was most recently addressed is being performed, a sustain period is selectively performed on the pixels of the other of the plurality of groups that have already undergone an address period.

BRIEF DESCRIPTION OF THE DRAWINGS

The above and other features and advantages of the present invention will become more apparent by describing in detail exemplary embodiments thereof with reference to the attached drawings.

FIG. 10A illustrates a method of representing a gradation of a single frame using a plurality of sub-fields.

DETAILED DESCRIPTION OF THE INVENTION

Figure 7:
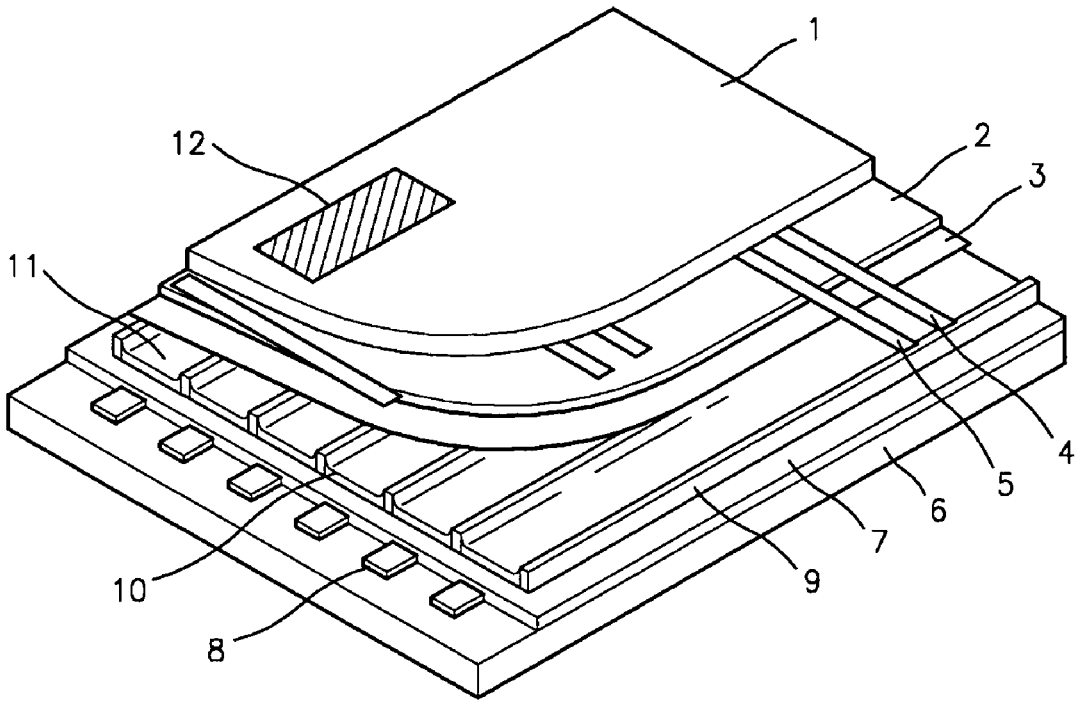
FIG. 7 is a partial perspective view of an AC-type PDP.

FIG. 7 illustrates an AC-type PDP having pairs of a scan electrode 4 and a sustain (common) electrode 5, which are covered with a dielectric layer 2 and a protective layer 3 and a first glass substrate 1. A plurality of address electrodes 8 covered with an isolation layer 7 are disposed on a second glass substrate 6. Partition walls 9 are disposed on portions of the isolation layer 7 that exist between address electrodes 8 and in parallel to the address electrodes 8. A phosphor 10 fills the spaces defined by the surface of the isolation layer 7 and the sides of the partition walls 9. The first glass substrate 1 and the second glass substrate 6 are disposed having a discharge space 11 there between and the scan electrodes 4 and the sustain electrodes 5 cross the address electrodes 8 at a right angle. A portion of the discharge space 11 where an address electrode 8 intersects a pair of a scan electrode 4 and a sustain electrode 5 forms a discharge cell 12.

Figure 8:
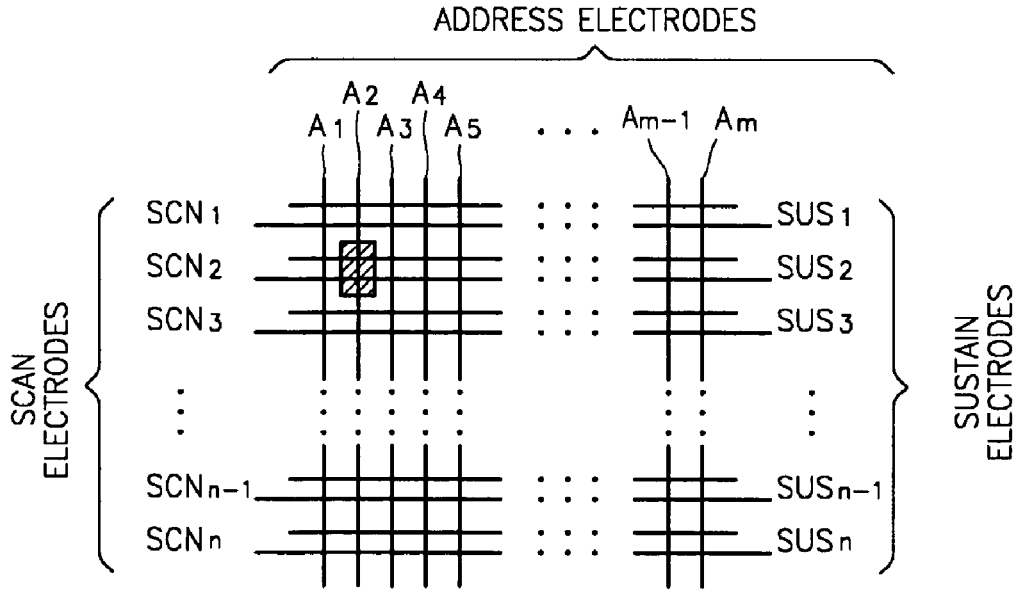
FIG. 8 illustrates an exemplary arrangement of electrodes of a panel.

FIG. 8 is illustrates an exemplary arrangement of electrodes in a panel. Electrodes are formed in an m×n matrix. Address electrodes $A_1$ through $A_m$ are arranged in the row direction, and n scan electrodes $SCN_1$ through $SCN_n$ and n sustain electrodes $SUS_1$ through $SUS_n$ are disposed in the column direction. A discharge cell shown in FIG. 8 corresponds to the discharge cell 12 of FIG. 7.

Figure 9:
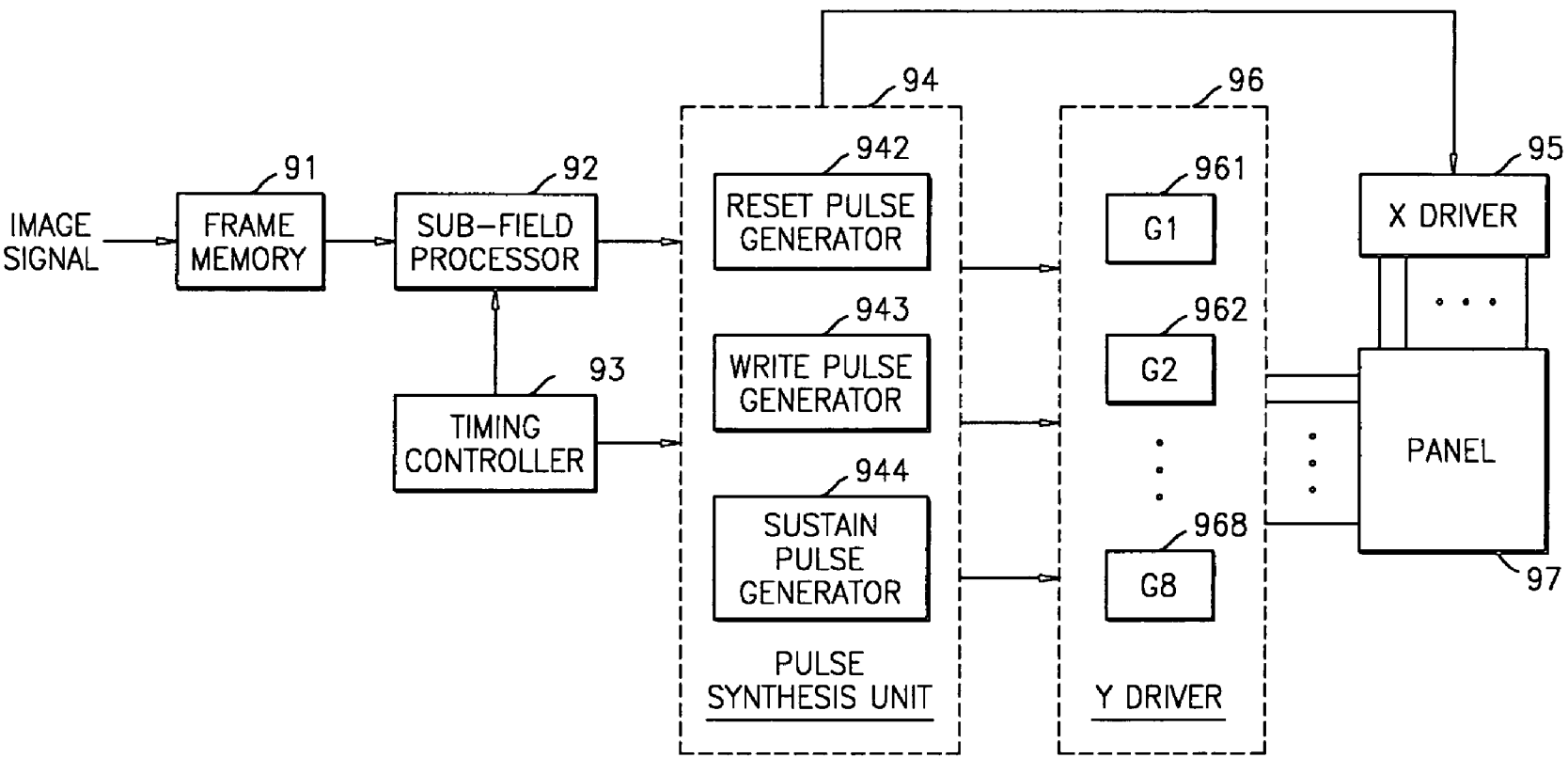
FIG. 9 is a block diagram of a panel driving apparatus according to this invention.

FIG. 9 is a block diagram of a panel driving apparatus according to an embodiment of this invention. An analog image signal to be displayed on a panel 97 is converted into a digital image signal and recorded in a frame memory 91. A sub-field processor 92 divides digital data stored in the frame memory 91 into sub-fields, as necessary, and outputs a sub-field at a time. For example, to represent a gradation on the panel 97, a single frame of pixel data stored in the frame memory 91 is divided into a plurality of sub-fields, and data of individual sub-fields are output.

In order to drive address electrodes, scan electrodes, and sustain electrodes that form the pixels of the panel 97, a pulse synthesis unit 94 includes a reset pulse generator 942, a write pulse generator 943, and a sustain pulse generator 944 for generating signals to be applied to the above three types of electrodes during a reset period, an address period, and a sustain period, respectively. The reset pulse generator 942 generates a reset pulse for resetting the state of each cell. The write pulse generator 943 generates address pulses for selectively addressing the cells to be lit. The sustain pulse generator 944 generates sustain pulses for discharging the cells addressed by the address pulses. A signal generated by the pulse synthesis unit 94 is applied to a scan electrode (Y) driver 96 and a sustain electrode (X) driver 95 in accordance with a predetermined timing.

The scan electrodes (Y) of the panel 97 are classified into a plurality of groups G1 through G8. The Y driver 96 includes a plurality of driving circuits 961 through 968 for driving the scan electrodes belonging to the groups G1 through G8, respectively. The X driver 95 drives the sustain electrodes of the panel 97 and a timing controller 93 generates various timing signals for operating the sub-field processor 92 and the pulse synthesis unit 94.

A method in which the panel driving apparatus of FIG. 9 drives the electrodes of a panel to represent a gradation will now be described in detail.

FIG. 10A illustrates a method of representing gradation of a single frame using a plurality of sub-fields. A single frame period that forms a picture is divided into a plurality of sub-fields, to which different gray scales are allocated. A desired gradation can be obtained by operating at least one sub-field selected from the plurality of sub-fields.

A gradation (or gray scale) of visual brightness is proportional to the number of sustain pulses applied to cells during a frame period. A single frame period corresponding to a single picture is divided into a plurality of sub-fields in time domain, and a predetermined number of sustain pulses is allocated to each of the plurality of sub-fields. Thus, a gradation is determined by an accumulation of sustain pulses allocated to the selectively operated sub-fields.

A single frame corresponding to a single picture is typically divided into 8 sub-fields to provide a 256-grade gradation. Different numbers of sustain pulses may be allocated to the sub-fields at a ratio of 1:2:4:8:16:32:64:128, and sustain periods are allocated to the respective sub-fields in approximately proportional to this ratio. Thus, FIG. 10A shows an example of a division of a single frame into 8 sub-fields to represent a 256-grade gradation on a screen. For example, a 17 grade brightness can be obtained by addressing and sustain-discharging cells over sub-fields Nos. 1 and 5.

A gradation weight allocated to each of the sub-fields can vary in consideration of gamma characteristics or panel characteristics. For example, 8 grades allocated to sub-field No. 4 can be lowered to 6 grades, and 32 grades allocated to sub-field No. 6 can be increased to 34 grades. Also, the number of sub-fields that compose a frame can vary depending on the design of a panel.

To implement a panel driving method according to this invention, the pixels of a panel are classified into a plurality of groups, and the pixels of individual groups are independently operated. In the case of an AC-type PDP, scan electrodes are classified into a plurality of groups according to a predetermined manner, which is described below.

Figure 10B:
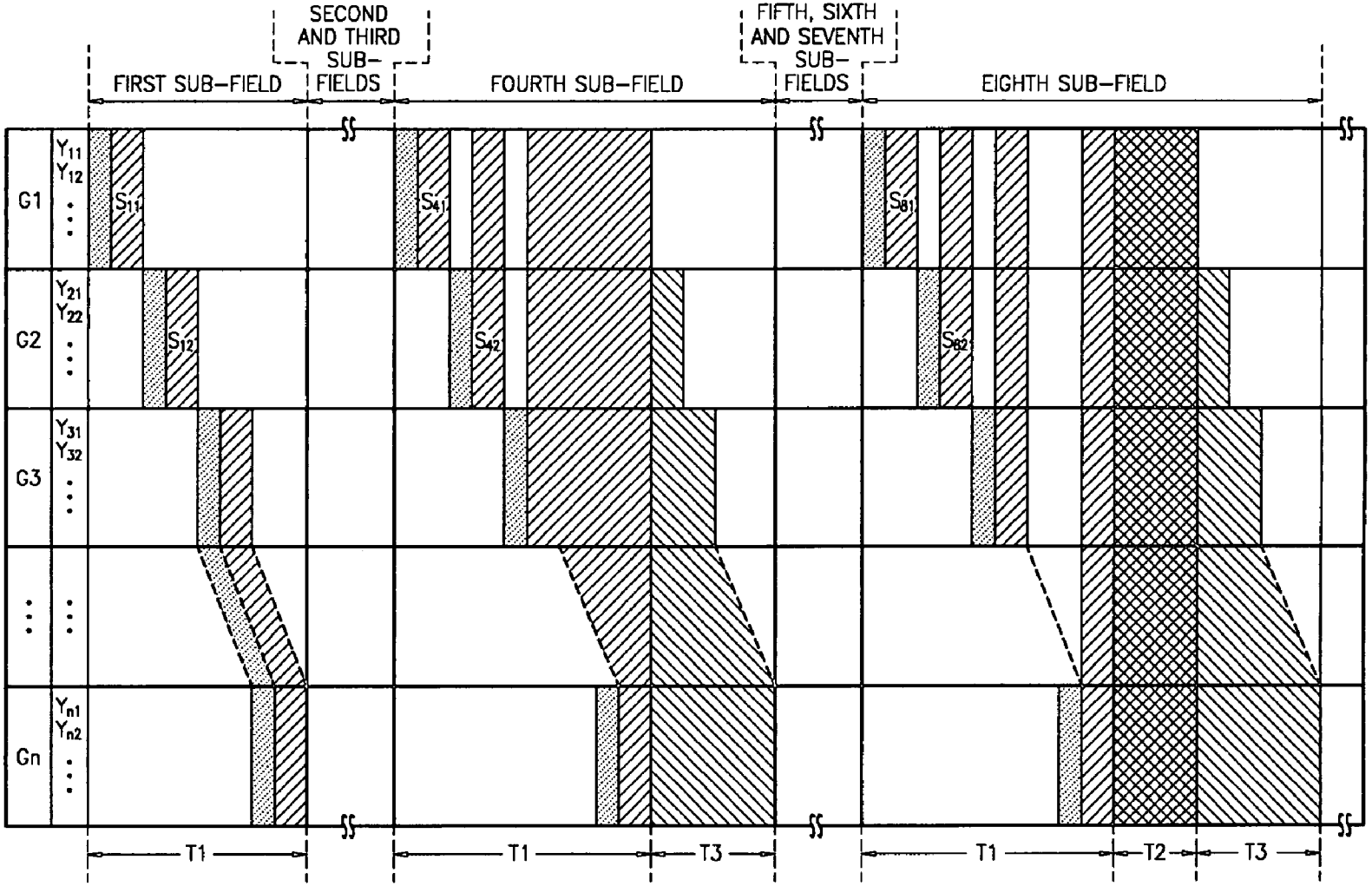
FIG. 10B illustrates a panel driving method for representing a gradation according to this invention.

FIG. 10B illustrates a panel driving method for representing a gradation according to this invention. Depending on the number of allocated grades, sustain periods of different lengths are allocated to a plurality of sub-field periods for a single frame. As in the example of FIG. 10A, if $2^n$ grades are sequentially allocated to the sub-fields, a sustain period allocated to sub-field No. 8 is basically 128 times longer than a sustain period allocated to sub-field No. 1. Accordingly, the sub-fields have sustain periods with significantly different lengths, and thus it is preferable to drive the pixels of individual sub-fields differently.

The sub-fields to which a small number of grades are allocated, such as, sub-field Nos. 1 through 3, the sustain periods for representing the allocated grades are relatively short. Thus, each of these sub-fields may be composed, for example, of a write/sustain mixed period (T1). On the other hand, sub-fields with a high number of allocated grades, such as sub-field Nos. 5 through 8, have relatively long sustain periods for representing the allocated grades. Thus, each of these sub-fields may be composed, for example, of a write/sustain mixed period T1, a concurrent sustain period T2, and a brightness compensation period T3. Further, sub-field No. 4, for example, may be composed of the write/sustain mixed period T1 and the brightness compensation period T3 without the concurrent sustain period T2.

In FIG. 10B, a dotted block indicates a write (address) period, a left-hatched block indicates the sustain period of the write/sustain mixed period T1, a left-right-hatched block indicates the concurrent sustain period T2, and a right-hatched block indicates the sustain period of the brightness compensation period T3.

In sub-fields to which a relatively low gradation is allocated, an address period and a sustain period are sequentially performed on the pixels of the first group G1. Thereafter, an address period and a sustain period are sequentially performed on the pixels of the second group G2. Thus, an address period and a sustain period are sequentially performed on the pixels of individual groups. In the first subfield of driving method illustrated in FIG. 10B, while the pixels of a certain group undergo an address period and a sustain period, the pixels of the other groups are idle. This proves that a sub-field can be composed of only the write/sustain mixed period T1 because the gradation allocated to the first sub-field is satisfied by executing a sustain period one time.

In sub-fields to which a relatively high gradation is allocated, an address period and a sustain period are sequentially performed on the pixels of the first group G1 and then on the pixels of the second group G2. While the sustain period is performed on the second group G2, it is also performed on the already addressed pixels of the first group G1. Likewise, while a certain group undergoes a sustain period subsequent to an address period, the already addressed pixels of the other groups may also undergo a sustain period. In this case, either all, some or none of the already addressed groups may undergo an address period. After execution of this write/sustain mixed period T1 is completed, different gradations may be obtained by the different groups.

The write/sustain mixed period T1 is followed by the concurrent sustain period T2 in which a sustain period is concurrently performed on the pixels of all of the groups for a predetermined period of time. Thereafter, an additional sustain period (brightness compensation period T3) is optionally performed on the pixels of individual groups. During the brightness compensation period T3, differences in gradations between groups during the write/sustain mixed period T1 are compensated so that all of the groups have the same gradation.

Meanwhile, in a sub-field having an intermediate gradation, an address period and a sustain period are sequentially performed on the pixels of each of the groups over the write/sustain mixed period T1. The write/sustain mixed period T1 is followed by a brightness compensation period T3.

During the write/sustain mixed period T1, while a sustain period is performed on the pixels of one group, the sustain period is also performed on the pixels of all or some of the already-addressed groups. However, if the gradation allocated to the sub-field is satisfied by sustain periods already performed on a certain group, the group will no longer undergo a sustain period while a sustain period is being performed on the next group. When an address period and a sustain period are completely performed on the pixels of all of the groups, that is, when the write/sustain mixed period T1 has been completed, the groups addressed earlier among the plurality of groups satisfy the allocated gradation, but the groups addressed later may not satisfy the allocated gradation. Hence, the pixels of the groups that do not satisfy the predetermined gradation selectively undergo an additional sustain period (that is, a brightness compensation period T3) in order to satisfy the intermediate gradation.

As shown in FIG. 10B, some of the sub-fields included in a frame are each comprised of only a write/sustain mixed period T1 (hereinafter called "the first way"), some are each comprised of a write/sustain mixed period T1 and a brightness compensation period T3 (hereinafter called "the second way"), and some are each comprised of a write/sustain mixed period T1, a concurrent sustain period T2, and a brightness compensation period T3 (hereinafter called "the third way"). If, while a sustain period is performed on a group, the other groups selectively undergo a sustain period, all of the subfields can be formed in any of the three ways. Also, one or some of the subfields may be formed, for example, in any of the three ways, while the other subfields are formed in the known address-sustain separation way. Generally, however, the sub-fields to which a relatively low gradation is allocated should adopt the first way, while the sub-fields to which a relatively high gradation is allocated should adopt the third way.

As described above, in a panel driving method according to this invention, individual sub-fields can be adaptively driven depending on the degree of a gradation allocated to each of the sub-fields. Also, in a write/sustain mixed period T1 for a sub-field, the length of a sustain period following an address period performed on a certain group is generally set to be equal to that performed on other groups.

However, the length of the sustain period following an address period may be set to be different from the other groups. Furthermore, the length of a single sustain period in a write/sustain mixed period T1 of a certain sub-field may be different from that of the other sub-fields. For example, in the fourth sub-field, the length of a sustain period $S_{41}$ following an address period performed on the first group G1 can be set to be equal to or different from that of a sustain period $S_{42}$ performed on the second group G2 following an address period. Also, for example, the length of a sustain period $S_{41}$ performed on the first group G1 of the fourth sub-field can be set to be equal to or different from the length of a sustain period $S_{11}$ performed on the first group G1 in the first sub-field.

FIGS. 1A through 6C illustrate various examples of formed sub-fields. A frame is formed of a plurality of sub-fields and each sub-field can be formed of one of several ways depending on a gradation allocated to the sub-field. A conventional electrode driving method that is not described in this specification can be used to form some sub-fields.

A panel driving method used to represent a gradation according to this invention will now be described and can be performed in the structure and device illustrated in FIGS. 7, 8, and 9. A process of dividing a frame into sub-fields and sequentially performing an address period and a sustain period on each of the sub-fields, or a process of sequentially performing an address period and a sustain period on a plurality of groups can be easily performed in the device of FIG. 9.

Figure 1A:
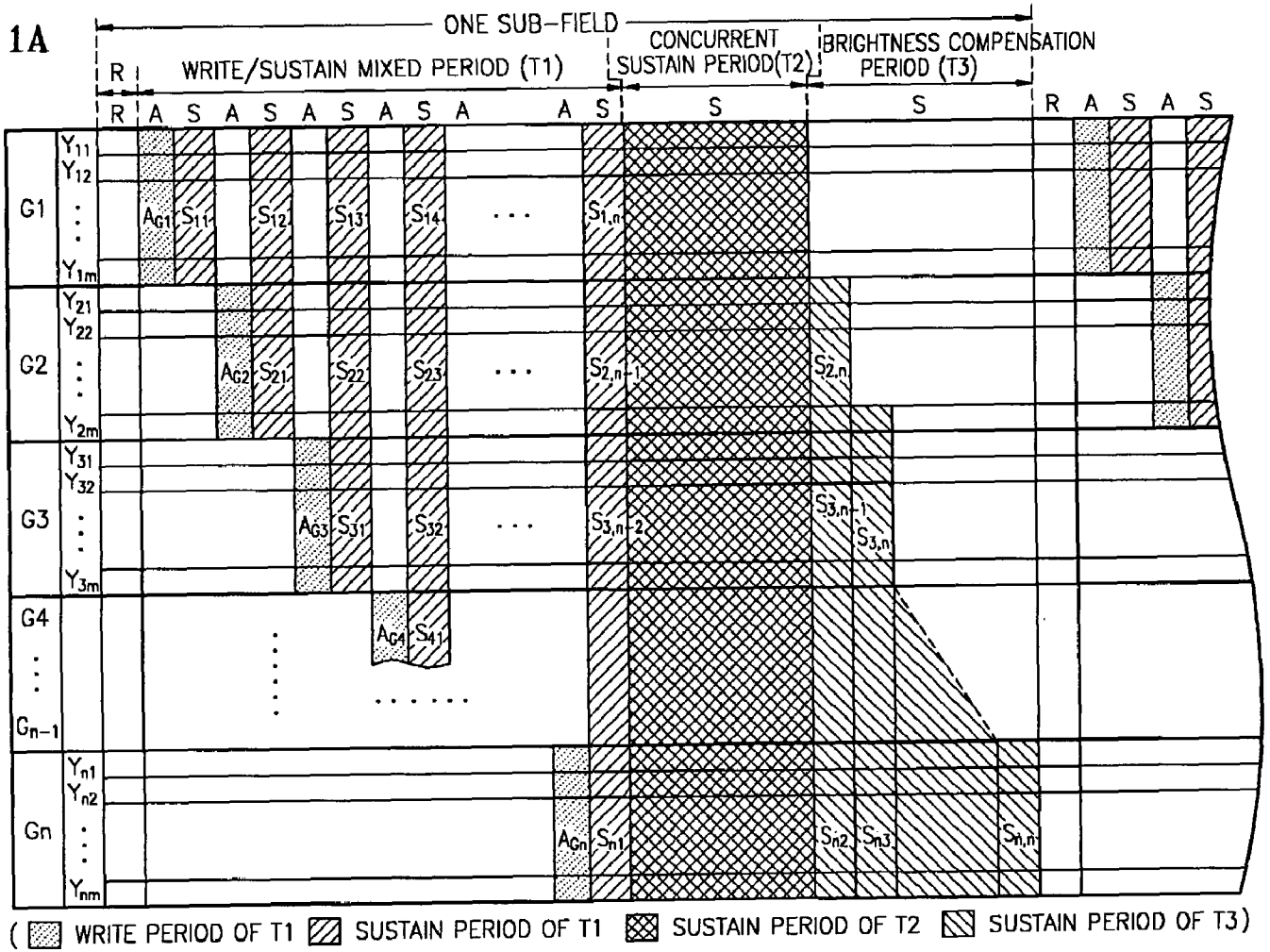
FIGS. 1A and 1B illustrate a panel driving method according to a first embodiment of this invention.

FIG. 1A illustrates a panel driving method according to an embodiment of this invention, in which the pixels of a panel are classified into a plurality of groups, and the pixels of each of the groups are addressed and sustained.

The scan electrodes of a panel are classified into a plurality of groups G1 through Gn, and the scan electrodes belonging to each of the groups G1 through Gn are sequentially addressed. After the addressing of one group is completed, sustain discharge pulses are applied to the electrodes of the group to perform a sustain period. When the electrodes of a certain group undergo a sustain period, the addressed electrodes in the other groups may also selectively undergo a sustain period. As described above, after an address period and a predetermined sustain period are sequentially performed on the pixels of a certain group, an address period is performed on the scan electrodes of other groups that have not yet been addressed. Here, when the scan electrodes of a panel are classified into a plurality of groups, an equal number or a different number of scan electrodes may be allocated to each group.

FIG. 1A illustrates a single sub-field formed of a reset period R, a write/sustain mixed period T1, a concurrent sustain period T2, and a brightness compensation period T3. In FIG. 1A, a dotted block indicates a write (address) period of the write/sustain mixed period T1, a left-hatched block indicates a sustain period of the write/sustain mixed period T1, a left-right hatched block indicates a sustain period of the concurrent sustain period T2, and a right-hatched block indicates a sustain period of the brightness compensation period T3.

The reset period R resets the state of a wall charge of pixels by applying reset pulses to the scan lines of all of the groups. Instead of concurrently performing a reset period on all of the groups, a reset period may be performed on individual groups before an address period is performed on the pixels of each of the groups.

Figure 1B:
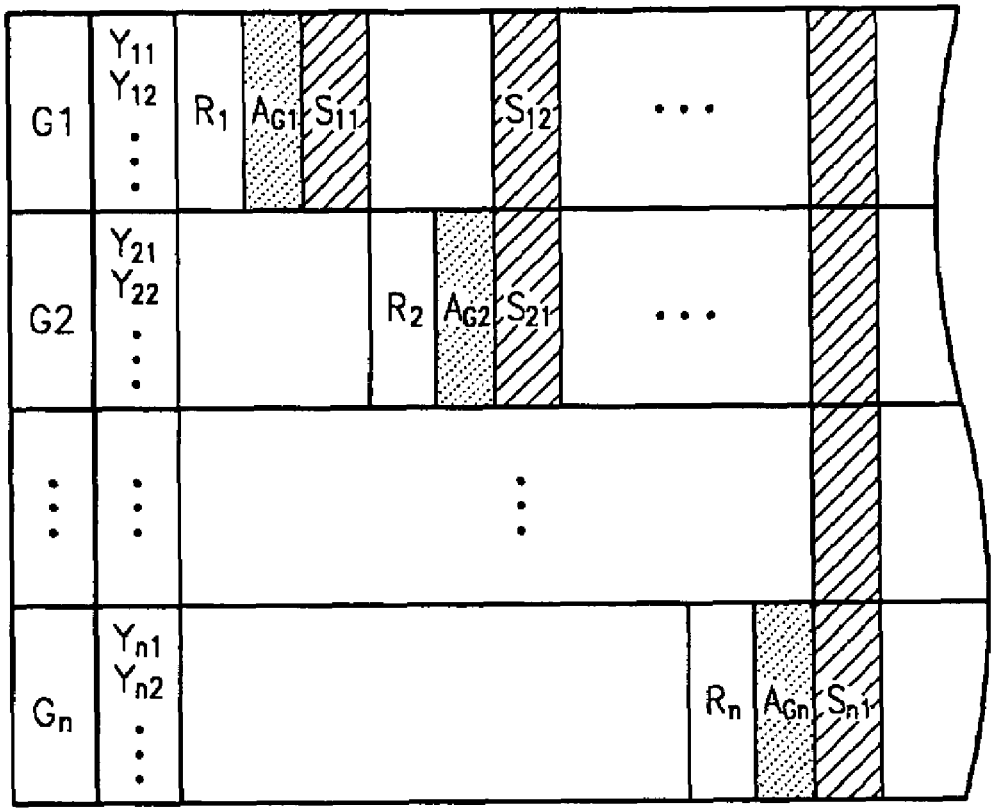

FIG. 1B illustrates reset periods performed on individual groups before an address period and a sustain period are performed in the way as illustrated in FIG. 1A. As shown in FIG. 1B, after a first reset period $R_1$ is performed on the pixels of the first group G1, an address period $A_{G1}$ and a sustain period $S_{11}$ are performed on the pixels of the first group G1. After the sustain period $S_{11}$, a second reset period $R_2$ is performed on the pixels of the second group G2. Then, an address period $A_{G2}$ is performed on the second group G2, and subsequently sustain periods $S_{12}$ and $S_{21}$ are concurrently performed on the pixels of the first and second groups G1 and G2. The process is continued through all the groups in the frame.

Looking at the write/sustain mixed period T1 shown in FIG. 1A, an address period $A_{G1}$ is performed by applying, in sequence, scan pulses to the first through m-th scan lines $Y_{11}$ through $Y_{1m}$ of the first group G1. After the pixels of the first group are all addressed, a sustain period $S_{11}$ is performed to sustain and discharge the addressed pixels using a predetermined number of sustain pulses.

After the sustain period $S_{11}$ is performed on the first group G1, an address period $A_{G2}$ is performed on the pixels of the second group G2. In an embodiment of this invention, during the address period $A_{G2}$ for the second group G2, sustain pulses are not applied to the pixels of other groups. However, after a scan pulse is applied to a scan electrode in the second group and before a next scan pulse is applied to the next scan electrode in the second group, it is possible to apply sustain pulses to the electrodes of other groups. This execution of an address period can be equally applied to the other groups.

If an address period $A_{G2}$ for the second group G2 is completed, that is, if the scan electrodes of the second group G2 are all completely addressed, a first sustain period $S_{21}$ for the second group G2 is performed. At this time, the first group on which an address period has already been performed is subjected to a second sustain period $S_{12}$. However, it should be understood that it is possible not to perform the second sustain period $S_{12}$ on the first group when the first sustain period $S_{21}$ is being performed on the second group. Further, the pixels that have not yet undergone an address period are idle.

When the first sustain period $S_{21}$ of the second group has been concluded, an address period $A_{G3}$ and a first sustain period $S_{31}$ are performed on the third group in the above-described way. During the first sustain period $S_{31}$ being performed on the third group, sustain periods $S_{13}$ and $S_{22}$ may also be performed on the pixels of the first group G1 and the second group G2 that have already been subjected to an address period. However, as discussed above, it is not necessary for the sustain periods to also be performed on any or all of the pixels of the previously addressed groups.

Through this process, an address period $A_{Gn}$ is performed by applying scan pulses to the scan electrodes of the last group Gn in a sequence from the first electrode $Y_{n1}$ to the last electrode $Y_{nm}$. Then, a sustain period $S_{n1}$ is performed on the last group Gn. During the sustain period $S_{n1}$, sustain periods may also be performed on the pixels of other groups.

FIG. 1A illustrates a panel driving method, in which, while a sustain period is performed on the pixels of a certain group, the pixels of all of the groups that have already subjected to an address period are also subjected to a sustain period. If the number of sustain pulses applied during a single sustain period for each group is equal for individual groups, that is, if a brightness revealed by the sustain pulses applied during a single sustain period is equal for individual groups, the pixels of the first group G1 provide a brightness n times greater than the brightness provided by the n-th group Gn. The pixels of the second group G2 provide a brightness (n-1) times greater than the brightness provided by the n-th group Gn. The pixels of the (n-1)th group Gn-1 provide a brightness twice as much as the brightness provided by the n-th group Gn.

The write/sustain mixed period T1 performed in the above-described way is followed by the concurrent sustain period T2. During the concurrent sustain period T2, a sustain period is performed by applying sustain pulses concurrently to the pixels of all of the groups.

The above-described concurrent sustain period T2 is followed by the brightness compensation period T3. During the brightness compensation period T3, an additional sustain period is performed on individual groups in order to equalize different brightness values that are obtained due to different lengths of sustain periods performed on the individual groups. For example, the brightness of the first group G1 is determined by the sum of the sustain periods $S_{11}$, $S_{12}$, . . . , and $S_{1,n}$ performed over the write/sustain mixed period T1 and the concurrent sustain period T2. The pixels of the first group G1 provide the highest brightness at the point of time when the brightness compensation period T3 starts. The other groups can have the brightness of the first group by performing an additional sustain period $S_{2,n}$ on the pixels of the second group G2 and performing additional sustain periods $S_{3,n-1}$ and $S_{3,n}$ on the pixels of the third group G3. Here, the sustain period $S_{2,n}$ corresponds to the first sustain period $S_{11}$ for the first group, and the sustain periods $S_{3,n-1}$ and $S_{3,n}$ correspond to the first and second sustain periods $S_{11}$ and $S_{12}$ for the first group, respectively. Additional sustain periods $S_{n2}$, $S_{n3}$, . . . , and $S_{n,n}$ are performed on the pixels of the n-th group Gn. Through the above process, all of the pixels that constitute a panel have substantially identical brightness.

As described above, if sustain periods for all of the pixels are completed, one sub-field is completely driven, and then a reset period of the next sub-field starts.

Referring to the example of FIG. 1A, a single sub-field can be divided into three time domains that have different characteristics.

In the write/sustain mixed period T1, sustain periods and address periods are performed on all of the pixels of a panel. Thus, the write/sustain mixed period T1 denotes a time domain in which address periods and sustain periods are mixed during an identified time period. During the write/sustain mixed period T1, a sequence of an address period and a sustain period is repetitively performed on the pixels of each group. Also, after a sequence of an address period and a sustain period is performed on the pixels of a certain group, an address period for the pixels of the next group starts. Furthermore, while a sustain period is being performed on the pixels of a certain group, sustain periods are performed on the pixels of other groups that have already been subjected to address periods.

The concurrent sustain period T2 denotes a time domain where a predetermined length of a sustain period is performed concurrently on all of the pixels. The brightness compensation period T3 denotes a time domain where the different brightness levels of individual groups are compensated by performing an additional sustain period on selected individual groups, and consequently the gradations of the individual groups are matched with each other to obtain a predetermined gradation.

In the exemplary embodiments of this invention illustrated in FIGS. 1A and 1B, sustain periods for applying sustain pulses are performed over the write/sustain mixed period T1, the concurrent sustain period T2, and the brightness compensation period T3. The sustain pulses applied during the sustain period of the write/sustain mixed period T1 may be wider than or have higher voltage than those applied during the concurrent sustain period T2. By applying wider and/or higher voltage sustain pulses, each of the pixels can obtain a more sufficient wall charge after an address operation.

Figure 2A:
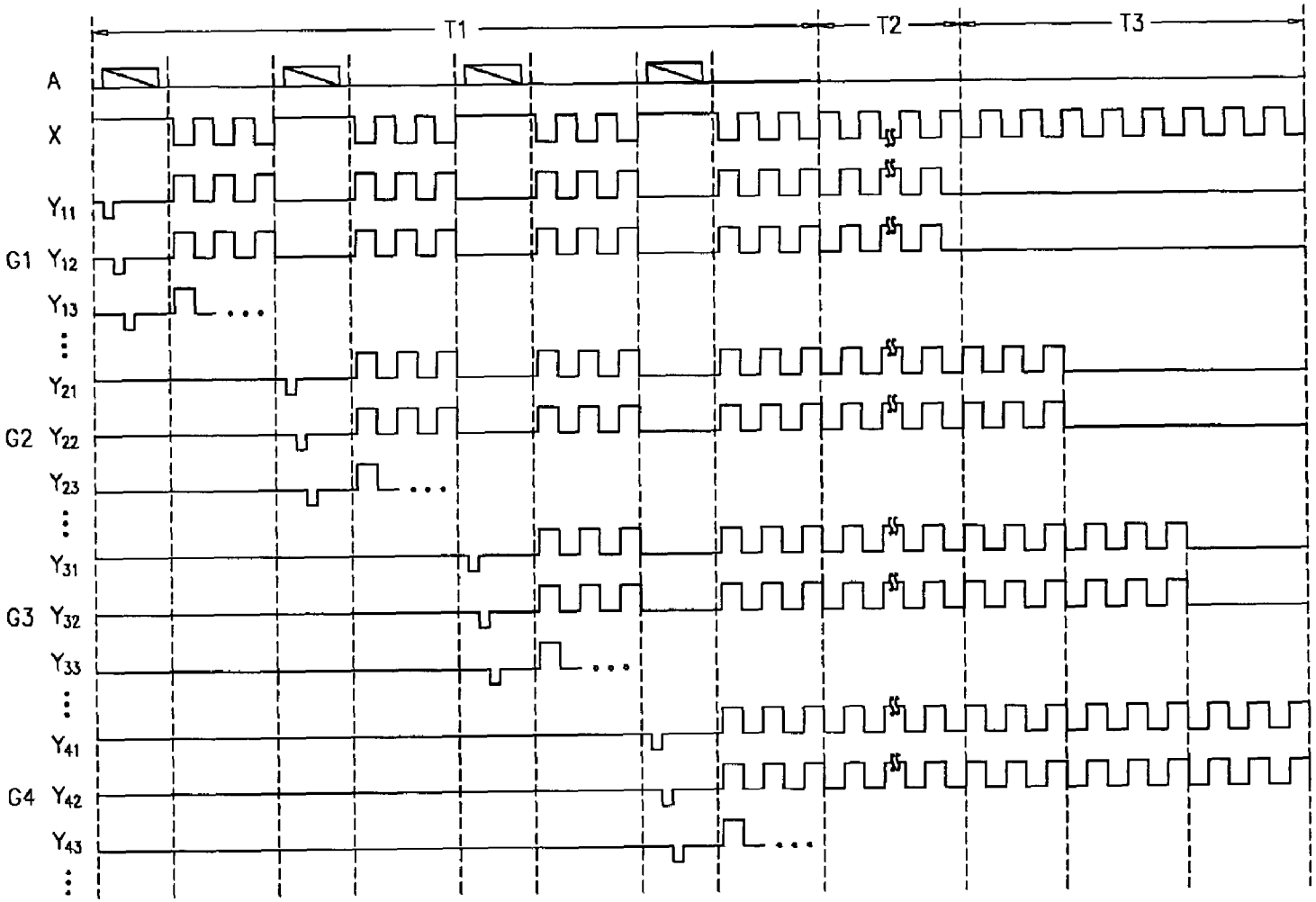
FIG. 2A illustrates an example in which the panel driving method of FIGS. 1A and 1B is applied to an AC-type PDP.

FIG. 2A illustrates an example in which the panel driving method of FIGS. 1A and 1B is applied to an AC-type PDP. During the write/sustain mixed period T1, when scan pulses are sequentially applied to the scan electrodes $Y_{11}$, $Y_{12}$, . . . that belong to the first group G1, addressing occurs according to the relationship between the scan pulses and the address pulses applied to address electrodes A. If all of the scan electrodes of the first group G1 are addressed, an address period for the first group G1 is terminated, and sustain discharge pulses are applied to common electrodes X and scan electrodes Y in order to perform a sustain period on all of the pixels of the first group G1.

For convenience of explanation, FIG. 2A shows application of three pairs of sustain pulses during one sustain period. A number of sustain pulses, which are enough to sustain and discharge addressed pixels is applied during a sustain period. For example, in order to represent a gradation of 256 grades, the number of sustain pulses required to represent at least one grade may, for example, be applied during a single sustain period. The sustain pulses are applied to the common electrodes X belonging to a group for which a sustain period is being performed. Also, if sustain pulses are applied to the common electrodes X but no sustain pulses are applied to the scan electrodes Y, sustain discharge does not occur in the pixels. Accordingly, sustain pulses may be applied to the common electrodes X of all of the groups.

After an address period and a sustain period for the first group G1 are concluded, an address period and a sustain period are performed on the second group G2. During the sustain period for the second group, the first group also undergoes a sustain period. The duration and/or the number of sustain pulses of sustain periods subsequent to address periods for the first group is not necessarily equal to that of the duration and/or the number of sustain pulses of the sustain period performed on the second group.

In the above-described way, an address period and a sustain period are sequentially performed on the pixels of the third group G3 and the pixels of the fourth group G4. Thereafter, the concurrent sustain period T2 and the brightness compensation period T3 are sequentially performed on the pixels of each group. During the concurrent sustain period T2, a sustain period is performed on the pixels of all of the groups. During the brightness compensation period T3, additional sustain periods are performed to equalize the brightness levels of individual groups.

Figure 2B:
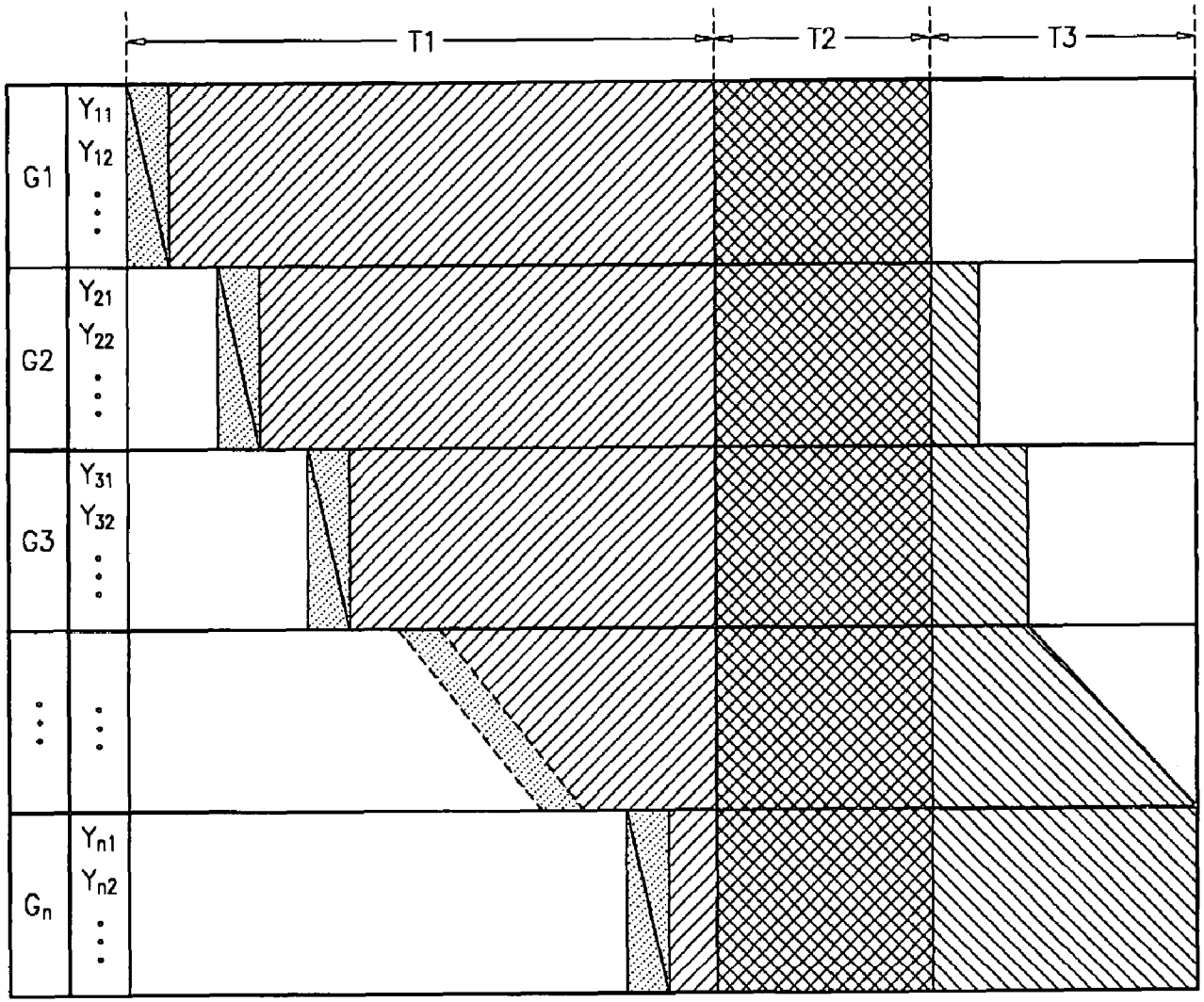
FIG. 2B conceptually illustrates the panel driving method according to this invention.

FIG. 2B conceptually illustrates the panel driving method according to this invention. During the write/sustain mixed period T1, the pixels of a panel are classified into a plurality of groups, and the individual groups sequentially undergo an address period in such a way that a sustain period for the pixels of at least one group is performed between an address period for a certain group and an address period for the next group. Accordingly, it can be seen from the timing relationship that sustain periods are performed during the time between the times the scan lines of the panel are sequentially being addressed. After the write/sustain mixed period T1 is completed in the above-described way, the concurrent sustain period T2 is performed on all of the pixels of the panel. Then, the brightness compensation period T3 is performed in such a way that an additional sustain period is selectively performed on the individual groups.

Figure 3A:
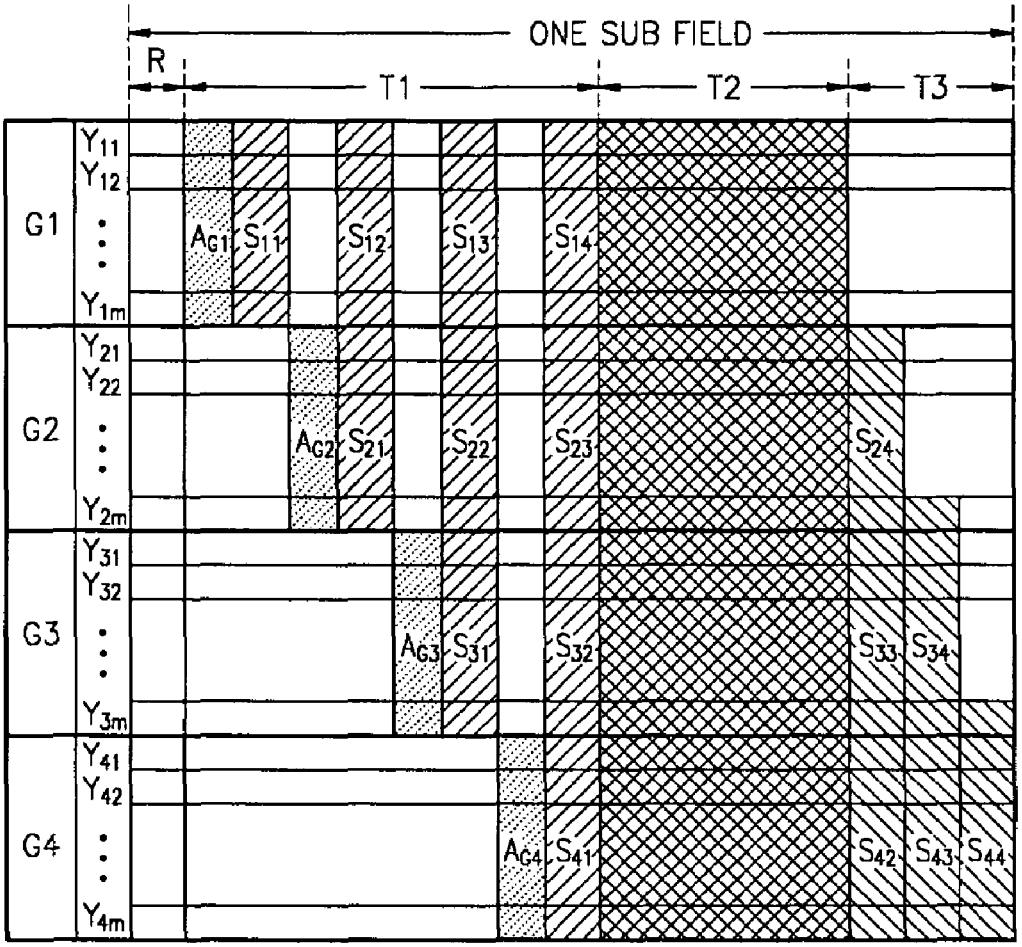
FIGS. 3A and 3B illustrate two ways in which the panel driving method according to this invention is performed in the case where the pixels of a panel are classified into four groups.

FIG. 3A illustrates an exemplary way in which the panel driving method according to this invention is performed when the pixels of a panel are classified into four groups. A sub-field is comprised of a reset period R, a write/sustain mixed period T1, a concurrent sustain period T2, and a brightness compensation period T3, which are operated in the manner as described in the above.

A plurality of scan electrodes that constitute a panel can be classified into a plurality of groups by grouping the scan electrodes by a predetermined number of sequential scan electrodes. If a panel is formed of, for example, 800 scan lines, the 800 scan lines may be classified into 8 groups in such a way that first through $100^{th}$ scan lines are classified into a first group, and $101^{st}$ through $200^{th}$ scan lines are classified into a second group, etc. Alternatively, the scan lines may be grouped in such a way that scan lines spaced from each other at intervals can be classified into a group. For example, first, ninth, seventeenth, . . . , and (8k+1)th scan electrodes are classified into a first group, and second, tenth, eighteenth, . . . , and (8k+2)th scan electrodes are classified into a second group, etc. The scan lines may also be grouped in arbitrary irregular ways.

In the case where non-adjacent scan lines are classified into a group, when a sustain period is performed subsequent to an address period for the scan electrodes of a certain group, priming occurs due to a sustain-discharge and drives charges to move to adjacent scan lines. Thus, the priming may contribute to an address operation on the adjacent scan lines. If the first group has undergone an address period and a sustain period, charges due to a priming caused by the sustain discharge operation on the first group are generated on the second, tenth, . . . , and (8k+2)th scan lines adjacent to the first, ninth, . . . , and (8k+1)th scan lines in the first group. In this case, the second group can be more securely addressed when an address period is performed on the second group.

Figure 3B:
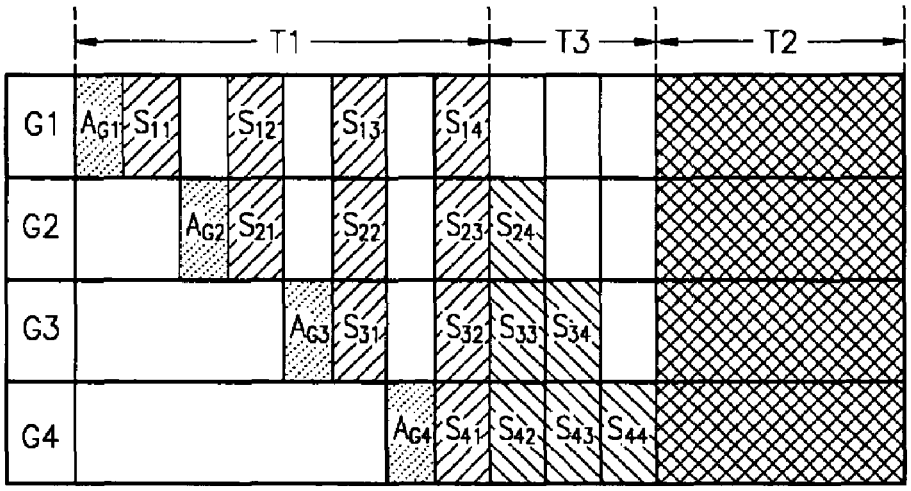

FIG. 3B illustrates another exemplary way in which the panel driving method according to this invention is performed when the pixels of a panel are classified into four groups. In FIG. 3B, a brightness compensation period T3 is performed before a concurrent sustain period T2. Thus, in this embodiment, after a write/sustain mixed period T1, the brightness compensation period T3 is performed to compensate for different brightness levels of individual groups so that the brightness levels of all pixels are matched with each other. After the brightness compensation period T3 is performed, a concurrent sustain period T2 is performed on all of the pixels, thereby obtaining a desired gradation. In other words, the brightness compensation period T3 is selectively performed on the individual groups in order to equalize the brightness levels of the groups differentiated due to different lengths of sustain periods performed on the groups during the write/sustain mixed period T1. During the concurrent sustain period T2, a predetermined length of sustain period is performed concurrently on all of the groups to obtain a desired gradation.

Figure 4A:
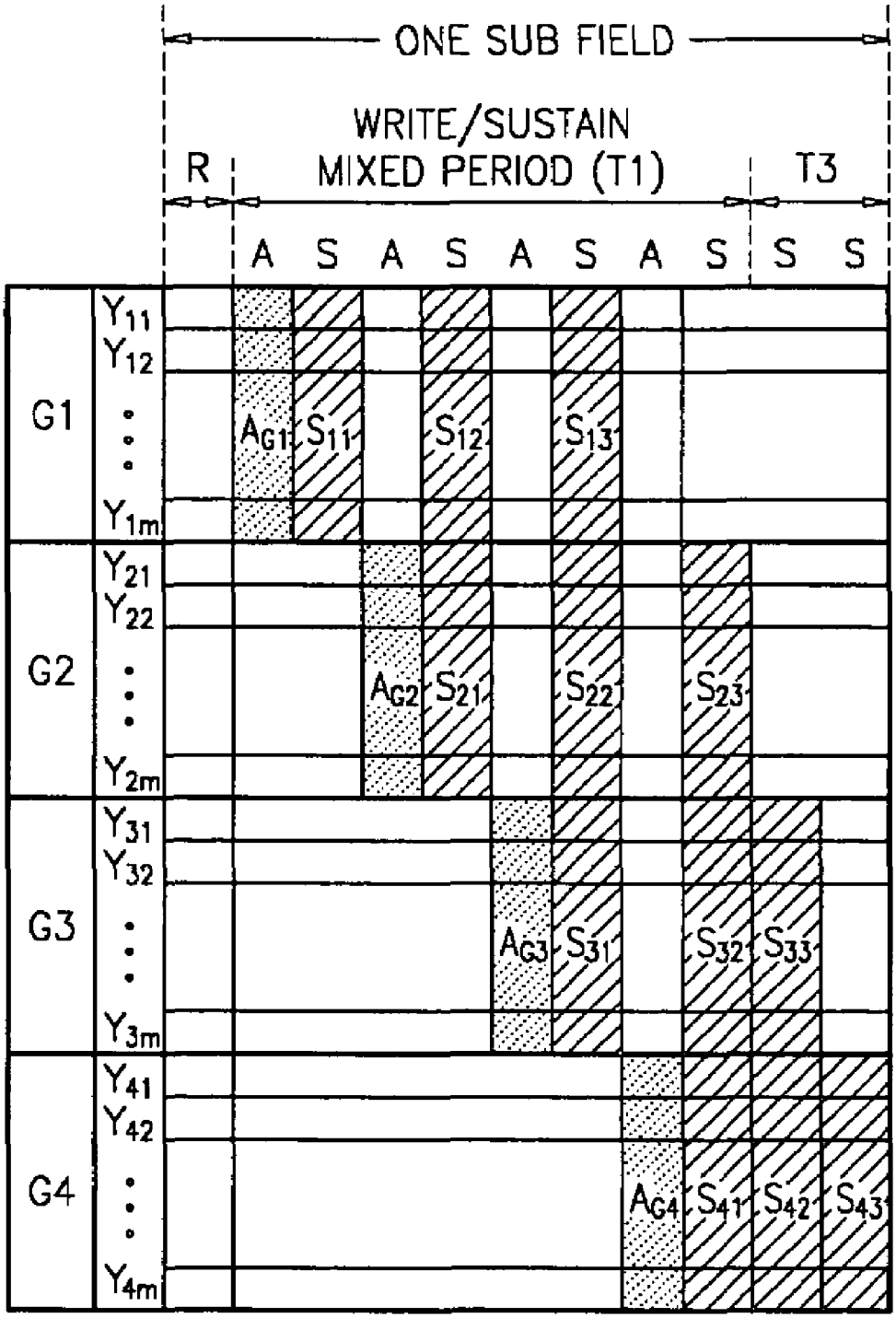
FIGS. 4A, 4B, and 4C are timing diagrams for illustrating various examples in which the panel driving method according to this invention is performed.
Figure 4B:
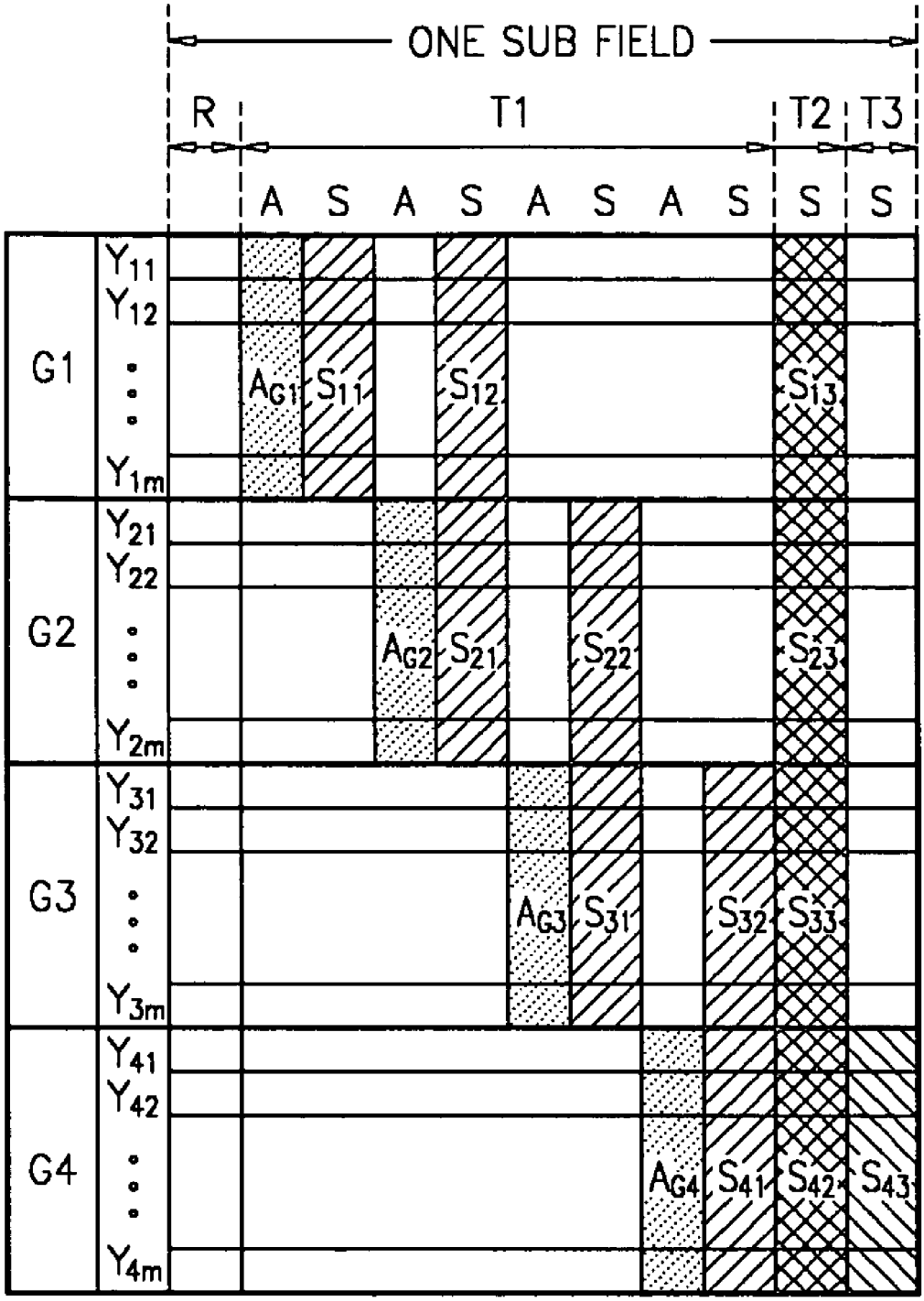
Figure 4C:
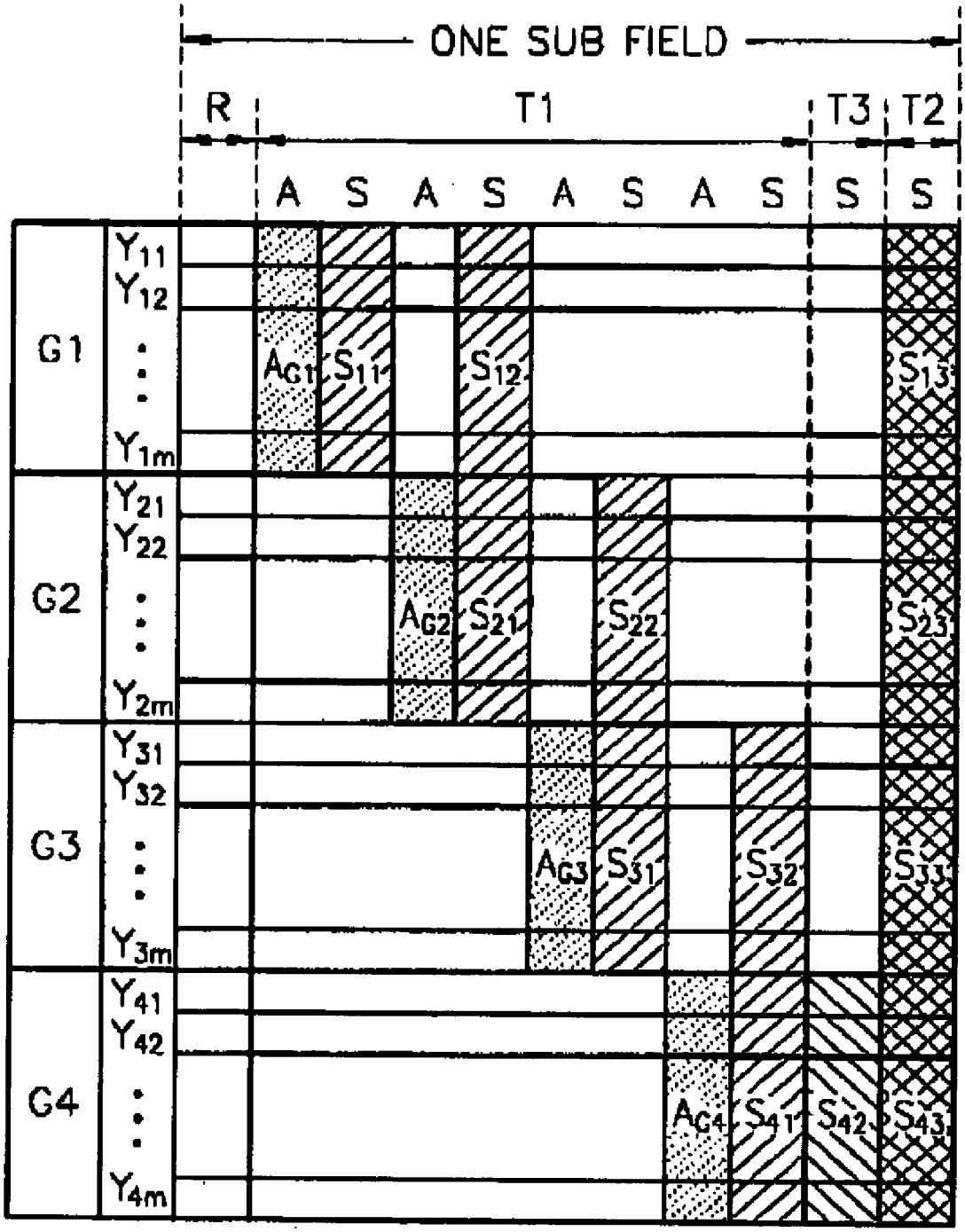

FIGS. 4A through 4C illustrate various embodiments of a panel driving method according to this invention. If a maximum number of 90 sustain pulses, for example, are allocated to a sub-field, the sustain pulses can be divided to the individual sustain periods in various ways for the various embodiments of the panel driving method according to this invention. If the pixels of a panel are classified into four groups and driven in the way illustrated in FIG. 3A, 10 sustain pulses are allocated to each of the sustain periods of the write/sustain mixed period T1, and 50 sustain pulses are allocated for a concurrent sustain period T2.

In this example, with regards to the first group, 10*4 sustain pulses are allocated to a write/sustain mixed period T1 for the first group, and 50 sustain pulses are allocated to a concurrent sustain period T2 for the first group. With regards to the second group, 10*3 sustain pulses are allocated to a write/sustain mixed period T1 for the second group, 50 sustain pulses are allocated to a concurrent sustain period T2 for the second group, and 10 sustain pulses are allocated to a brightness compensation period T3 for the second group. Similarly, with regards to the third group, 10*2 sustain pulses are allocated to a write/sustain mixed period T1 for the third group, 50 sustain pulses are allocated to a concurrent sustain period T2 for the third group, and 20 sustain pulses are allocated to a brightness compensation T3 for the third group. With regards to the fourth group, 10*1 sustain pulses are allocated to a write/sustain mixed period T1 for the fourth group, 50 sustain pulses are allocated to a concurrent sustain period T2 for the fourth group, and 30 sustain pulses are allocated to a brightness compensation T3 for the third group.

It should be understood that the number of sustain pulses applied to each of the sustain periods of the write/sustain mixed period T1 can be different and can, for example, be determined according to a design specification. If 30 sustain pulses, for example, are allocated to each of the sustain periods, the timing diagram of FIG. 4A is obtained. During the write/sustain mixed period T1 for the first group, all of 90 sustain pulses, for example, can be applied through three sustain periods corresponding to the address periods for the first through third groups. Accordingly, while a sustain period is being performed subsequent to an address period of the fourth group, sustain pulses are not applied to the pixels of the first group. The third group undergoes sustain periods $S_{31}$ and $S_{32}$ in the write/sustain mixed period T1 and then undergoes an additional sustain period $S_{33}$ in order to match the brightness of the pixels in that group with the brightness levels of the pixels in the first and second groups. The fourth group is operated in the same way as described above.

As described above, FIG. 4A shows a timing diagram of an exemplary embodiment of the panel driving method according to this invention in which a sub-field is comprised of a write/sustain mixed period T1 and a brightness compensation period T3. The sub-field shown in FIG. 4A does not have a concurrent sustain period, and thus, in this exemplary embodiment, sustain pulses allocated to obtain a gradation for one sub-field must be applied to at least one group during the sustain periods included in the write/sustain mixed period T1. The sustain pulses allocated for one sub-field must be applied to at least one group during the sustain periods because there is no concurrent sustain period to obtain the desired gradation.

In the exemplary embodiment of a panel driving method according to this invention shown in FIG. 4A, the pixels of a panel are classified into a plurality of groups, and each of the groups is addressed and sustain-discharged so that the pixels of each group have a predetermined gradation. During the write/sustain mixed period T1, while a sustain period is performed on the pixels of a certain group, sustain periods are also performed on the pixels of other groups that have already undergone an address period. If a predetermined gradation for a group is obtained during the sustain periods already performed, the group is in an idle state while other groups undergo sustain periods. For example, as shown in FIG. 4A, after an address period and a sustain period are completely performed on the pixels of the last group, the groups G2, G3 and G4 that do not satisfy the predetermined gradation selectively undergo an additional sustain period, while the group G1 which has already undergone a predetermined gradation, remains idle.

FIG. 4B illustrates a panel driving method in which a sustain period $S_{13}$ for a first group, a sustain period $S_{23}$ for a second group, a sustain period $S_{33}$ for a third group, and a sustain period $S_{42}$ for a fourth group are performed at the same time. In this exemplary embodiment, while a sustain period is performed on a certain group in a write/sustain mixed period T1, other groups that have already undergone address periods may or may not be subjected to sustain periods. The numbers of sustain pulses allocated during each of the sustain periods included in the write/sustain mixed period T1 may be set to be completely equal to each other. Alternatively, some of the sustain periods may be set to have an equal number of sustain pulses. Alternatively, all of the sustain periods may be set to have different numbers of sustain pulses.

FIG. 4C illustrates a panel driving method in which in contrast with the driving method illustrated in FIG. 4B, a write/sustain mixed period T1 is followed by a brightness compensation period T3, which is followed by a concurrent sustain period T2.

Figure 5:
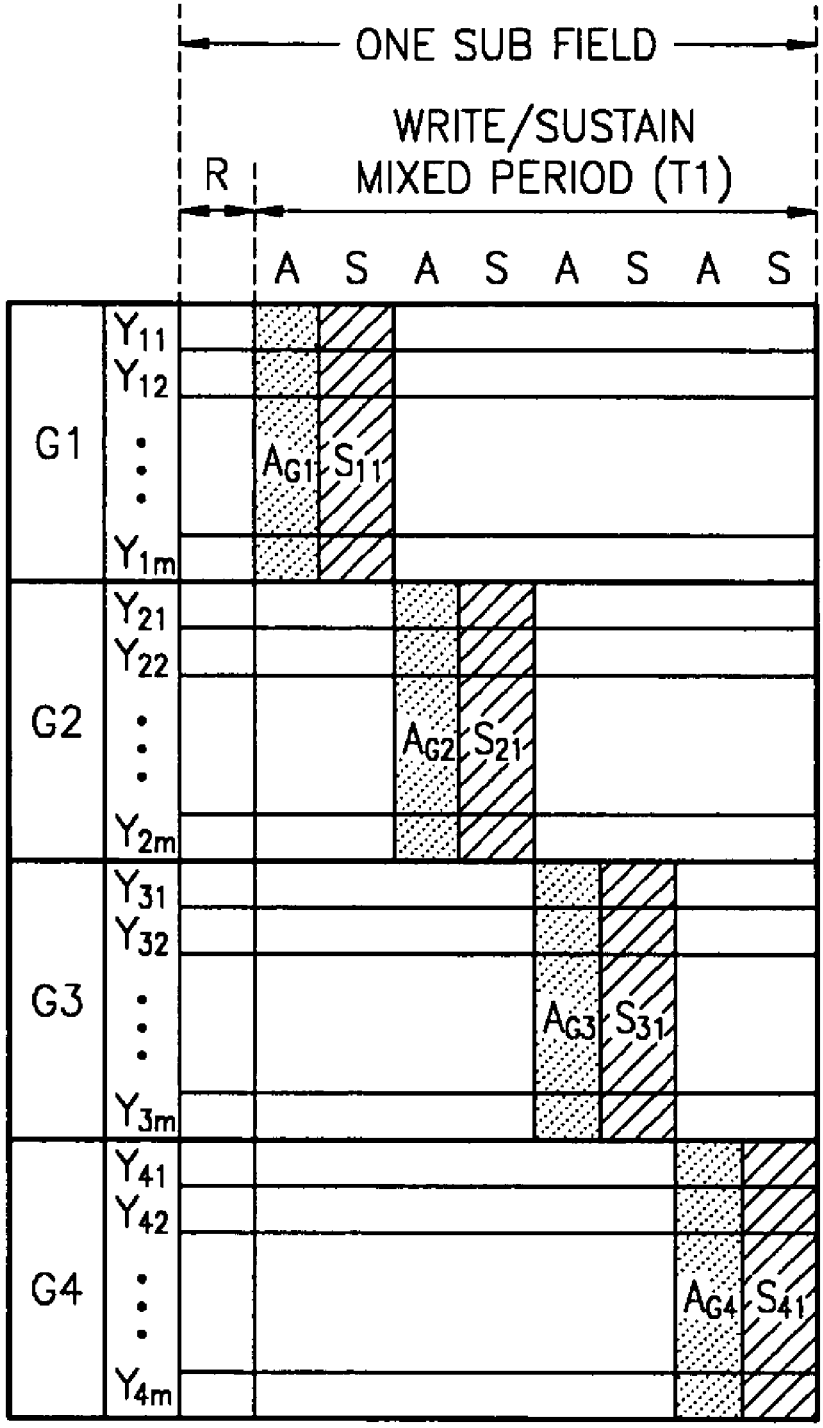
FIG. 5 is a timing diagram for illustrating a panel driving method according to a second embodiment of this invention.

FIG. 5 is a timing diagram for illustrating a panel driving method according to an embodiment of the present invention. An addressing operation is performed by sequentially applying address pulses to the scan electrodes of the first group. When the addressing operation on all of the scan electrodes of the first group is complete, a sustain operation is performed by applying sustain pulses to the scan electrodes.

When the sustain period for the first group is complete, an address operation and a sustain discharge operation are sequentially performed on the scan electrodes of the second group. In this way, all of the groups from the first to last groups undergo a sequence of an address period and a sustain period. The panel driving method according to an embodiment illustrated in FIG. 5 is useful, for example, in the case where all of sustain pulses, the number of which is required to obtain a desired gradation, can be allocated during a single sustain period in a write/sustain mixed period T1. Accordingly, in this embodiment, an address period and a sustain period are sequentially performed on individual groups.

Figure 6A:
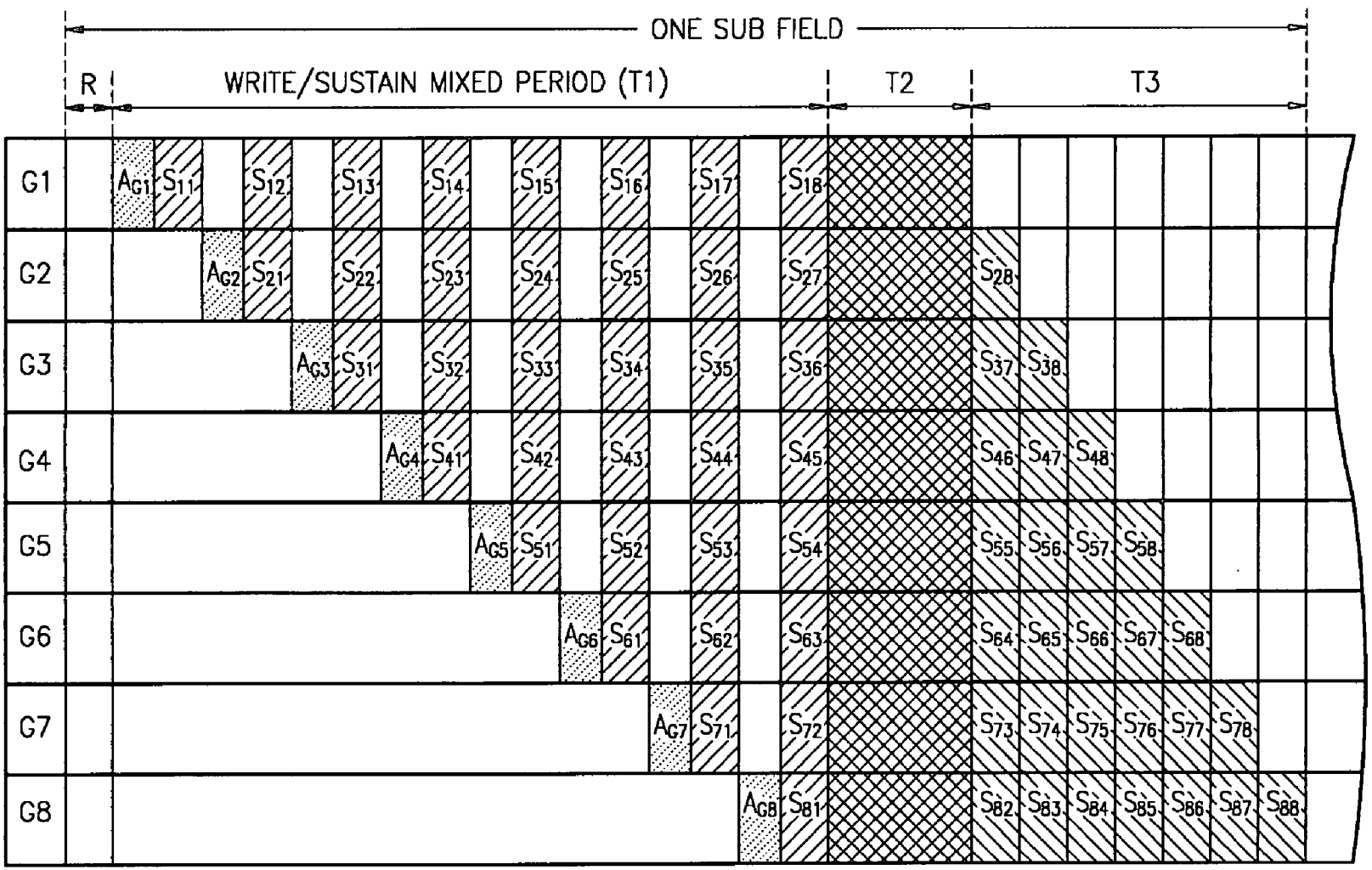
FIGS. 6A, 6B, and 6C illustrate various examples in which a panel driving method according to this invention is applied to 8 of pixels.
Figure 6B:
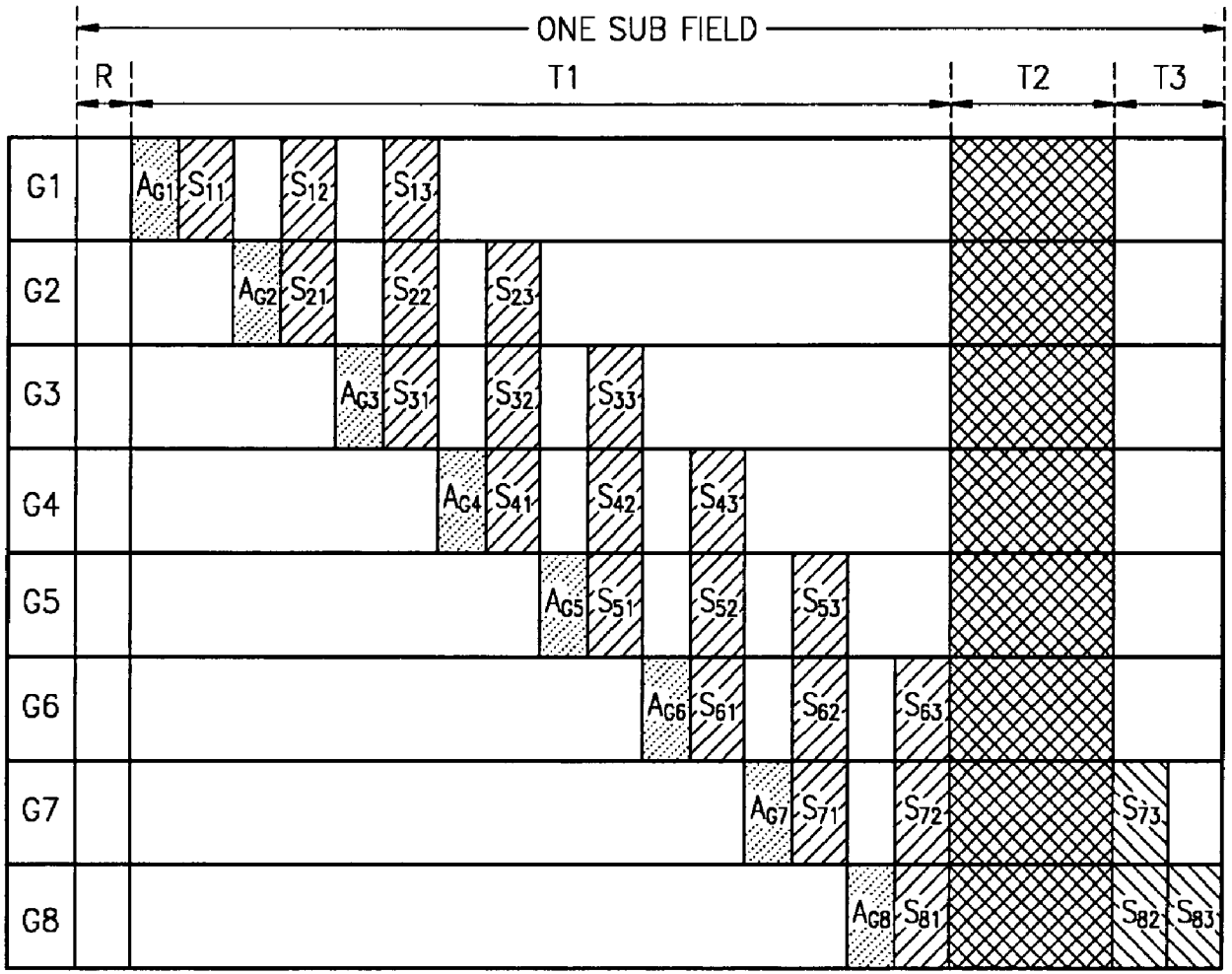
Figure 6C:
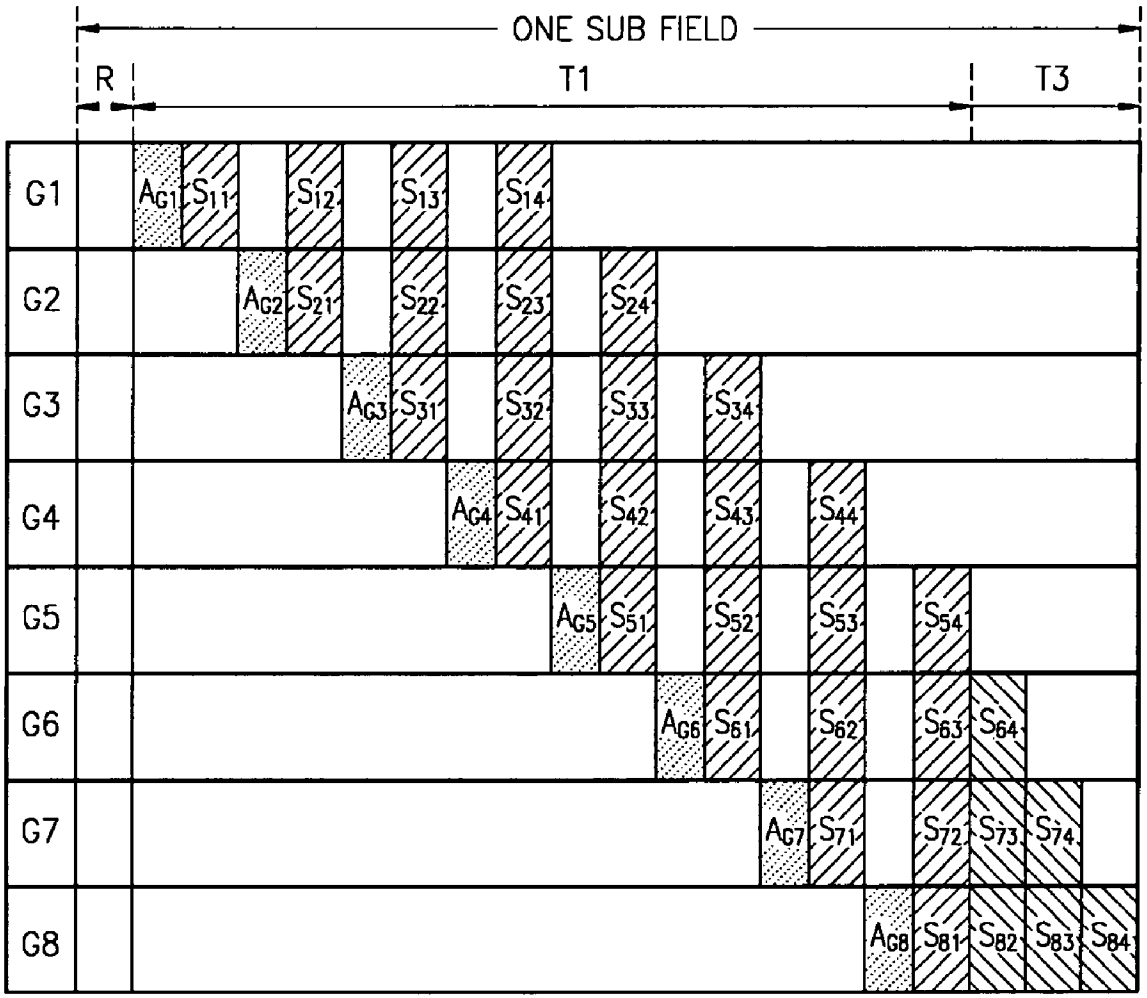

FIGS. 6A through 6C illustrate various examples in which a panel driving method according to the present invention is applied to 8 groups into which the pixels of a panel are classified. FIG. 6A illustrates a panel driving method in which a sub-field is comprised of a write/sustain mixed period T1, a concurrent sustain period T2, and a brightness compensation period T3. The panel driving method of FIG. 6A is substantially the same as the panel driving method of FIG. 3A.

FIG. 6B illustrates a panel driving method in which during a write/sustain mixed period T1, while a sustain period is being performed on a certain group, sustain periods are selectively performed on groups that have already undergone an address period. FIG. 6C illustrates a panel driving method in which a sub-field is comprised of a write/sustain mixed period T1 and a brightness compensation period T3.

As discussed above, FIG. 9 is a block diagram of a panel driving apparatus in which the above-described panel driving methods are implemented. In the pulse synthesis unit 94 and the Y driver 96, address and sustain operations according to this invention are performed on the pixels of the panel 97.

The panel driving apparatus according to the present invention addresses and sustain-discharges the pixels of each of a plurality of groups into which the pixels of the panel 97 are classified. The pulse synthesis unit 94 generates an address signal and a sustain signal so that an address period and a sustain period are sequentially performed on the pixels of each of the groups. While an address period is being performed on the pixels of a certain group, the pixels of other groups are idle. While a sustain period is being performed subsequent to the address period for the group, groups that have already undergone an address period are selectively subjected to sustain periods.

The Y driver 96 performs an address period by applying scan pulses to the scan electrodes of individual groups and simultaneously, at least substantially simultaneously, applying address pulses to address electrodes. The Y driver 96 also performs a sustain period by applying sustain pulses to the scan electrodes. Thus, address periods and sustain periods are mixed. The X driver 95 applies sustain pulses to sustain electrodes while a sustain period is being performed on the pixels of each of the groups.

The pulse synthesis unit 94 may also generate a sustain signal used to perform a predetermined length of a sustain period concurrently on the pixels of all of the groups after address periods have been performed on the pixels of all of the groups, so that a concurrent sustain period is performed. The pulse synthesis unit 94 may also generate a sustain signal used to selectively perform an additional sustain period on the pixels of each of the groups so that each of the groups satisfies a predetermined gradation. Thus, the pulse synthesis unit also may perform a brightness compensation period.

Preferably, while an address period and a sustain period are sequentially performed on individual groups, if the predetermined gradation is obtained for a certain group, the pixels of that group are maintained in an idle state while other groups undergo sustain periods.

Preferably, a reset period is performed concurrently on the pixels of all groups before an address period is performed on the pixels of the first group. Alternatively, it is preferable that a reset period is performed on the pixels of each group before the group undergoes an address period.

As described above, in the embodiments of the present invention, the pixels of a panel are classified into a plurality of groups, and an address period and a sustain period are sequentially performed on the pixels of each of the groups. While an address period is being performed on the pixels of a certain group, the pixels of other groups are idle. While a sustain period is being performed on the pixels of a certain group after an address period, sustain periods are selectively performed on the pixels of groups that have already undergone address periods. Each of the first through n-th groups has selectively undergone a sustain period between adjacent address periods.

The above-described panel electrode driving methods according to the present invention are all applicable to display devices that sequentially perform an address period for previously selecting a cell to be lit and a sustain period for lighting the selected cell. For example, it is apparent to those skilled in the art that the technical spirit of the present invention can be applied to display devices that display a picture by sequentially performing an address period and a sustain period using space charges, such as, AC-type PDPs, DC-type PDPs, EL display devices, or liquid crystal displays (LCDs).

The invention can also be embodied as computer readable codes on a computer readable recording medium. The computer readable recording medium is any data storage device that can store programs or data which can be thereafter read by a computer system. Examples of the computer readable recording medium include read-only memory (ROM), random-access memory (RAM), CD-ROMs, magnetic tapes, had disks, floppy disks, flash memory, optical data storage devices, and so on. Here, a program stored in a recording medium is expressed in a series of instructions used directly or indirectly within a device with a data processing capability, such as, computers. Thus, a term "computer" involves all devices with data processing capability in which a particular function is performed according to a program using a memory, input/output devices, and arithmetic logics. For example, a panel driving apparatus can be considered a computer for performing a panel driving operation.

The pulse synthesis unit 94 included in the panel driving apparatus may be implemented by an integrated circuit including a memory and a processor, thus the pulse synthesis unit 94 can store a program for executing a panel driving method in the memory. When a panel is driven, the program stored in the memory is executed to perform addressing and sustaining operations according to this invention. Therefore, an integrated circuit in which a program for executing a panel driving method is stored can be interpreted as any of the above-enumerated recording media.

While this invention has been particularly shown and described with reference to exemplary embodiments thereof, it will be understood by those of ordinary skill in the art that various changes in form and details may be made therein without departing from the spirit and scope of this invention as defined by the following claims.

As described above, in a panel driving method and apparatus according to this invention in which a gradation is represented with frames and subfields, the pixels of a panel are classified into a plurality of groups, and a sequence of an address period and a sustain period is repeatedly performed on each of the groups during each sub-field. Therefore, a sustain discharge operation is performed within a short period of time after an address operation is performed on each of the pixels, so that a stable sustain discharge occurs even though narrow scan pulses and address pulses may be applied during the address operation. Accordingly, the time required to address all pixels is reduced, making it possible to allocate longer time to a sustain discharging operation during one TV field. Therefore, the brightness of a screen is improved, and a large panel with many scan lines can represent a high gradation. Furthermore, each of the sub-fields can be adaptively driven based on a gradation allocated to the sub-field.

What is claimed is:

1. A panel driving method for driving pixels of a panel, wherein the pixels are classified into a plurality of groups and the pixels of one of the plurality of groups are addressed and sustain-discharged before the pixels of another one of the plurality of groups are addressed and sustain-discharged, a frame period for displaying a single image is divided into a plurality of sub-fields to each of which a predetermined gradation weight is allocated, the sub-fields are selectively operated to determine a gradation of visual brightness for each cell, and for at least one of the sub-fields, the method comprising:

during a write/sustain mixed period, sequentially applying, address signals, during an address period, and sustain signals, during a sustain period, to the pixels of one of the plurality of groups before applying address signals and sustain signals to the pixels of another of the plurality of groups, wherein the step of applying address signals and sustain signals is repeated for each of the plurality of groups and while a sustain period is being performed on the pixels of one of the plurality of groups, the pixels of others of the plurality of groups to which address signals and sustain signals have already been applied being are selectively subjected to sustain periods;

during a concurrent sustain period, performing a predetermined length of sustain period concurrently on the pixels of all of the plurality of groups; and during a brightness compensation period, selectively performing an additional sustain period on the pixels of each of the plurality of groups so that the pixels of each of the plurality of groups satisfy a predetermined gradation allocated to the sub-field.

2. The panel driving method of claim 1, wherein the write/sustain mixed period is first followed by the concurrent sustain period, and then followed by the brightness compensation period.

3. The panel driving method of claim 1, wherein the write/sustain mixed period is first followed by the brightness compensation period in order to equalize degradations differentiated for the each of the plurality of groups due to sustain periods performed on the each of the plurality of groups during the write/sustain mixed period, and then followed by the concurrent sustain period in order to obtain the predetermined gradation allocated to the sub-field.

4. The panel driving method of claim 1, wherein sustain pulses applied during a sustain period of the write/sustain mixed period are wider than and/or have a higher voltage than sustain pulses applied during sustain periods which do not occur during the write/sustain mixed period.

5. The panel driving method of claim 1, wherein during the write/sustain mixed period, a length of a sustain period occurring subsequent to an address period performed on one of the plurality of groups is different from a length of a sustain period subsequent to an address period performed on another of the plurality of groups.

6. The panel driving method of claim 1, further comprising concurrently applying reset signals to all of the plurality of groups before an address period is performed on one of the plurality of groups.

7. The panel driving method of claim 1, further comprising concurrently applying reset signals to all the pixels of one of the plurality of groups before applying address signals to the pixels of the group.

8. A panel driving method for driving pixels of a panel, wherein the pixels are classified into a plurality of groups and the pixels of one of the plurality of groups are addressed and sustain-discharged before the pixels of another one of the plurality of groups are addressed and sustain-discharged, a frame period for displaying a single image is divided into a plurality of sub-fields to each of which a predetermined gradation weight is allocated, and the sub-fields are selectively operated to determine a gradation of visual brightness for each cell, the method comprising driving at least one of the sub-fields by:

performing a sequence of an address period and a sustain period on the pixels of one of the plurality of groups before performing an address period on the pixels of another one of the plurality of groups, wherein:

the step of performing a sequence of an address period and a sustain period on the pixels of one of the plurality of groups is repeated until all of the plurality of groups have undergone the sequence of an address period and a sustain period, while performing the sustain period on the pixels of the group which was most recently addressed, a sustain period is selectively performed on the pixels of at least one other group that has already undergone an address period and has not yet obtained the predetermined gradation by the already performed sustain periods, and while the pixels of all the other groups of the plurality of groups that have already undergone an address period and have already obtained the predetermined gradation by the already performed sustain periods are maintained in an idle state; and after the pixels of all of the plurality of groups have undergone an address period and a sustain period, selectively performing an additional sustain period on the pixels of each of the plurality of groups that do not satisfy the predetermined gradation.

9. The panel driving method of claim 8, further comprising concurrently performing a reset period on all of the plurality of groups before an address period is performed on any of the plurality of groups.

10. The panel driving method of claim 8, further comprising performing a reset period on one of the plurality of groups before an address period is performed on the one of the plurality of groups.

11. A panel driving method for driving pixels of a panel, wherein the pixels are classified into a plurality of groups and the pixels of one of the plurality of groups are addressed and sustain-discharged before the pixels of another one of the plurality of groups are addressed and sustain-discharged, a frame period for displaying a single image is divided into a plurality of sub-fields to each of which a predetermined gradation weight is allocated, and the sub-fields are selectively operated to determine a gradation of visual brightness for each cell, and the method comprising driving at least one of the sub-fields by:

performing an address period on the pixels of one of the plurality of groups while the pixels of others of the plurality of groups are kept idle; and while performing the sustain period on the pixels of the group which was most recently addressed, performing a sustain period on the pixels of each of other groups that have already undergone an address period.

12. The panel driving method of any of claim 11, further comprising concurrently performing a reset period on all of the plurality of groups before an address period is performed on any of the plurality of groups.

13. The panel of claim 11, further comprising performing a reset period on one of the plurality of groups before an address period is performed on the one of the plurality of groups.

14. A panel driving apparatus comprising:

a sub-field processor dividing a frame period, during which a picture is displayed, into a plurality of sub-fields;

a signal synthesis unit which generates an address signal for addressing pixels to be lit and a sustain signal for sustain-discharging addressed pixels; and a pixel driving unit which selectively operates the sub-fields and drives the pixels of the individual groups in response to the address signals and the sustain signals that are output from the signal synthesis unit, to determine a gradation of visual brightness for each pixel, wherein the signal synthesis unit generates the address signals and the sustain signals so that at least one of the sub-fields is driven by sequentially performing an address period and a sustain period on the pixels of one of the plurality of groups in such a way that while an address period is being performed on the pixels of one of the plurality of groups, the pixels of other groups are idle, and while a sustain period on the pixels of the group which was most recently addressed is being performed, a sustain period is selectively performed on the pixels of the other of the plurality of groups that have already undergone an address period.

15. The panel driving apparatus of claim 14, wherein the signal synthesis unit further generates a sustain signal for performing a sustain period of a certain length concurrently on the pixels of all of the groups after the pixels of all of the groups have undergone address periods.

16. The panel driving apparatus of claim 14, wherein the signal synthesis unit further generates a sustain signal for performing an additional sustain period on the pixels of each of the groups so that the pixels of each of the groups satisfy the predetermined gradation.

17. The panel driving apparatus of claim 14, wherein the signal synthesis unit is operated so that, while an address period and a sustain period are sequentially being performed on the pixels of one of the plurality of groups, if a predetermined gradation is obtained for any of the other of plurality of groups, the pixels of the group which has obtained the predetermined gradation are idle even though others of the plurality of groups undergo sustain periods.

18. The panel driving apparatus of claim 14, wherein the signal synthesis unit is operated so that a reset period is concurrently performed on all of the groups before an address period is performed on one of the plurality of groups.

19. The panel driving apparatus of claim 14, wherein the signal synthesis unit is operated so that a reset period is performed on one of the plurality of groups before an address period is performed on the one of the plurality of groups.

* * * * *